US005167270A

United States Patent [19]

Henych

[11] Patent Number: 5,167,270

[45] Date of Patent: Dec. 1, 1992

[54] METHOD FOR THE TREATMENT OF FOUNDRY SAND AND/OR CORE SAND

[75] Inventor: Ivo Henych, Stetten, Switzerland

[73] Assignee: Georg Fischer AG, Schaffhausen, Switzerland

[21] Appl. No.: 645,123

[22] Filed: Jan. 24, 1991

[30] Foreign Application Priority Data

Jan. 31, 1990 [CH] Switzerland ..... 00310/90-0

[51] Int. Cl.[5] ..... B22C 5/00

[52] U.S. Cl. ..... 164/5

[58] Field of Search ..... 164/5, 520

[56] References Cited

U.S. PATENT DOCUMENTS

| | | | |
|---|---|---|---|
| 1,551,738 | 9/1925 | Fisher | 164/5 |
| 2,261,947 | 11/1941 | Barnebl et al. | 164/5 |
| 2,331,102 | 10/1943 | Bird | 164/5 |
| 2,478,461 | 8/1949 | Connolly | 164/5 |
| 2,766,496 | 10/1956 | Ward | 164/5 |
| 4,144,088 | 3/1979 | Adams | 164/5 |
| 4,303,453 | 12/1981 | Jung et al. | 164/5 |
| 4,449,566 | 5/1984 | Filipovitch et al. | 164/5 |
| 4,569,696 | 2/1986 | Sandstrom et al. | 164/5 |

FOREIGN PATENT DOCUMENTS

| | | | |
|---|---|---|---|
| 2320973 | 11/1974 | Fed. Rep. of Germany | 164/5 |
| 57-14442 | 1/1982 | Japan | 164/5 |

*Primary Examiner*—Richard K. Seidel
*Attorney, Agent, or Firm*—Bachman & LaPointe

[57] ABSTRACT

A method for the re-processing of used foundry sand comprises a two cycle system including a conventional processing system for foundry sand and a second locally independent regeneration system for the recovery of the usuable components of the used sand such as carbon dust and bentonite.

4 Claims, 1 Drawing Sheet

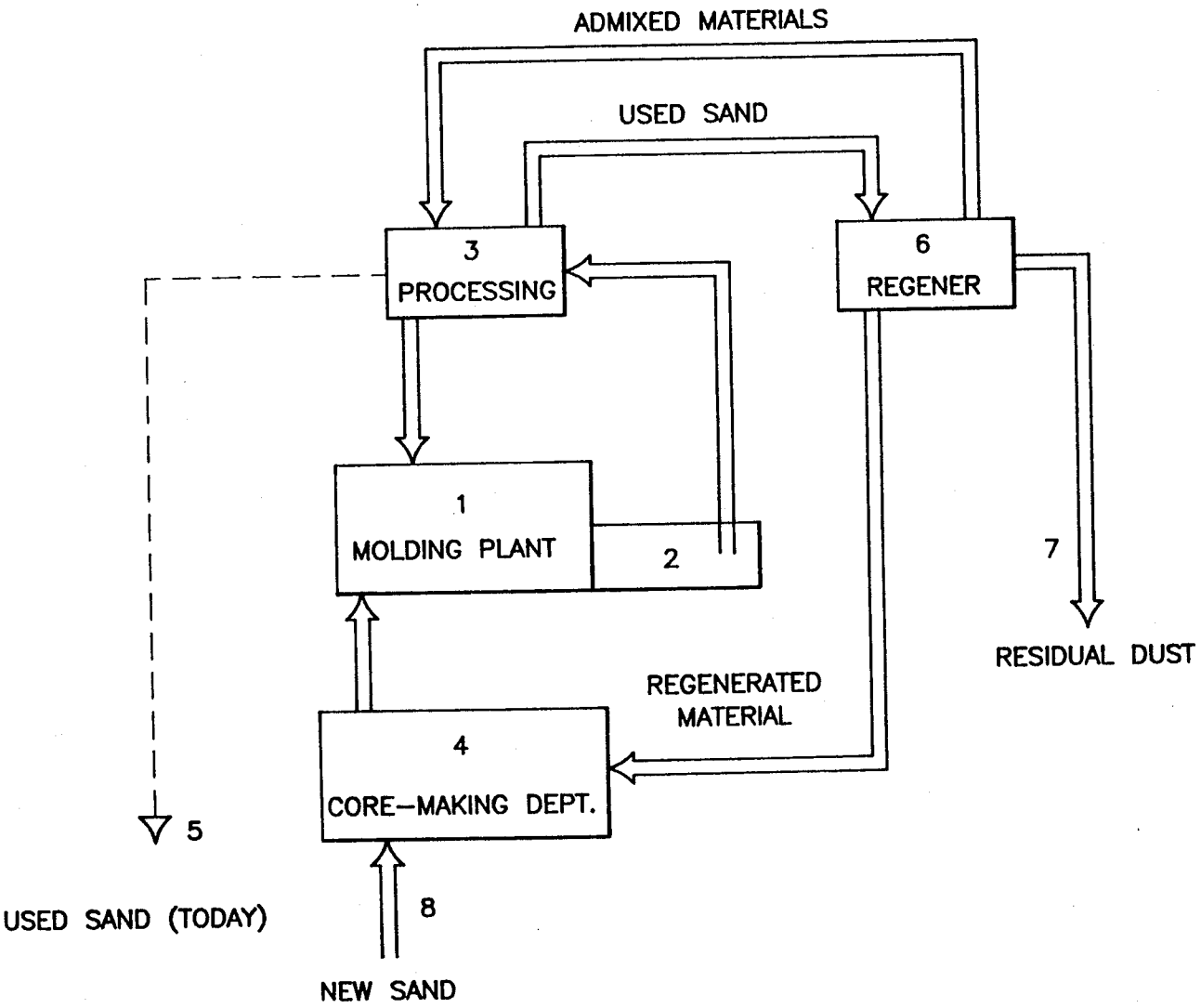
ADMIXED MATERIALS
USED SAND
6
REGENER
7
RESIDUAL DUST
3
PROCESSING
1
MOLDING PLANT
2
REGENERATED MATERIAL
4
CORE-MAKING DEPT.
8
NEW SAND
5
USED SAND (TODAY)

METHOD FOR THE TREATMENT OF FOUNDRY SAND AND/OR CORE SAND

BACKGROUND OF THE INVENTION

The present invention is drawn to a method for the treatment of foundry sand and/or core sand which is fed as a sand mould to a moulding plant and is subsequently, after metal casting has taken place, separated from the cast piece at an emptying station.

For producing cast pieces, moulds formed from foundry sand are commonly used. Due to the thermal effect of the liquid metal being cast, the sand is partly destroyed because of the binding agent used, for example bentonite, which burns due to the high temperatures of the liquid metal. The destroyed sand must be taken out of the cycle. By the addition of new sand in the form of cores, which serve to form the hollow spaces in the cast pieces, continuously fresh new sand is supplied to the system.

The excess sand must then be removed from the system and taken away to the waste tip. This so-called waste or used sand also contains, besides the sand (generally silica sand), moulding material admixtures such as bentonite and carbon carriers. Because of these admixture materials, the possibilities for re-use of waste sand in other areas (in building industry among other things) is limited. The used sand accumulating at foundries in the manner described above is therefore taken to waste tips.

Considered statistically, approximately 580 kg of used sand occur per ton of casting produced. Besides the economic disadvantages for the foundries themselves, the environmental burden necessitated by the disposal of the accumulating used sand is considerable.

Accordingly, it is the principle object of the present invention to provide a method for the economic re-use of the used sand. It is a further object of the present invention to achieve a substantial reduction in the environmental burden, in that the waste to be taken to the waste tip is reduced to a minimum.

SUMMARY OF THE INVENTION

In accordance with the present invention the foregoing objects and advantages are readily obtained.

The present invention is drawn to a method for the treatment of used sand containing admixed materials from sand moulds used for the production of metal cast pieces comprising:

(a) separating said sand mould from said metal cast piece;

(b) feeding a first position of said used sand from the sand mould to a first used sand processing system;

(c) feeding a second position of said used sand from the sand mould to a second used sand processing system;

(d) separating said used sand in said second processing system so as to obtain as-new sand, usable. admixed materials and residual dust; and (e) feeding said as-new sand is a core making station.

BRIEF DESCRIPTION OF THE DRAWINGS

The FIGURE is a flow diagram illustrating the method of the present invention.

DETAILED DESCRIPTION

The development of methods and devices for reclamation of used sand makes it possible to re-use the used sand to a certain extent (60 to 70%) and to feed it into the cycle. This is known in particular from DE-2909408.

The possibility also exists of separating out the admixed materials added to the sand and re-introducing them into the sand cycle as perfect constituents. Through the formation of a second cycle, besides the existing processing cycle, for the regeneration of the used sand, more than 50% of this used sand is recovered for re-use as core sand. The amount remaining to be taken to the waste tip is correspondingly reduced by this.

The flow diagram of the combined processing and reclaiming system, which is either directly integrated into the processing or can be located at a distance from it, shows the principle of the two cycle system.

The foundry sand from the moulding plant 1 and the emptying grid 2 is transported to the processing plant 3, where the separation of metal parts and the removal of sand lumps, among other things, takes place. Here or at another suitable place the portion of sand which is, for technological reasons, necessarily used sand 5, that is not recyclable, is branched off and, in previous methods, taken to the waste tip.

With the two cycle system, a portion of used sand is introduced into the second cycle 6, where a further regeneration takes place. Here the damaged sand cores and a part of the admixed materials (binders and the like such as bentonite and carbon carriers) are separated out. The reclaimed material, which consists of as-new sand, that is sand equivalent to new core sand, is then fed as core sand to the core-making department 4, and the recovered admixed materials are fed to the processing cycle 3. The residual dust, consisting of no longer usable grains of sand and binding agent residues 7 (approximately 20% of the volume of used sand) can either be taken directly to the waste tip, or compacted first into blocks, pellets etc., or mixed with liquid slag. The latter can be carried out advantageously in the cupola furnace.

EXAMPLE 4.5 t of used sand were removed per hour from the processing cycle and fed to the mechanical regeneration plant.

By the combined mechanical impact stress and shearing stress of the grains of sand with simultaneous drawing off by suction, the shells of admixed material are removed, and are separated from the unusable sand dust by wind sifting in the subsequent cyclone and filter. The reclaimed material, which is made up of 60 to 65% used sand, is fed as new sand directly to the core-making department. The dust separated out in the cyclone and the filter from the first phase of the regeneration contains 30 to 40% of the admixed materials, which are fed to the processing cycle system.

Use of the two cycle system reduced the requirement for admixture materials by 62%.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A method for the treatment of used sand containing admixed materials from a sand mold used for the production of a cast piece comprising:

(a) separating said sand mold from said cast piece;

(b) feeding said used sand from said sand mold to a first used sand processing system;

(c) treating and separating said used sand in said first processing system into useable used sand and unuseable used sand;

(d) feeding said useable used sand to a second used sand processing system;

(e) treating and separating said useable sand in said second processing system into as-new sand, admixed materials and residual dust wherein said admixed materials are drawn off in said second processing system by suction;

(f) recycling said as-new sand to a core making station for use in making sand mold; and (g) feeding said separated admixed materials to a molding plant wherein said admixed materials are reintroduced into the sand cycle as binder material.

2. A method according to claim 1 wherein said unuseable used sand from said first sand processing system is transferred to a waste tip.

3. A method according to claim 1 wherein said residual dust from said second sand processing system is transferred to a waste tip.

4. A method according to claim 1 wherein said admixed materials comprise bentonite and carbon.

* * * * *